US006695641B1

(12) United States Patent
Lee

(10) Patent No.: US 6,695,641 B1
(45) Date of Patent: Feb. 24, 2004

(54) CABLE CONNECTOR ASSEMBLY

(75) Inventor: George Lee, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/330,236

(22) Filed: Dec. 24, 2002

(51) Int. Cl.[7] ..... H01R 12/14
(52) U.S. Cl. ..... 439/493; 439/77
(58) Field of Search ..... 439/492–499, 439/564, 604, 77

(56) References Cited

U.S. PATENT DOCUMENTS 4,105,278 A * 8/1978 Braund et al. ..... 439/460
4,343,523 A * 8/1982 Cairns et al. ..... 439/588
5,518,421 A * 5/1996 Davis ..... 439/607
D412,700 S 8/1999 Gardner et al.
6,083,039 A * 7/2000 Finona ..... 439/493
6,162,086 A * 12/2000 Kuo ..... 439/497
6,203,335 B1 * 3/2001 Chang ..... 439/79
6,210,204 B1 * 4/2001 Ko et al. ..... 439/404
6,331,122 B1 * 12/2001 Wu ..... 439/567
6,478,586 B1 * 11/2002 Ma ..... 439/79
6,494,749 B1 * 12/2002 Chang ..... 439/701

* cited by examiner

*Primary Examiner*—Tho D. Ta
*Assistant Examiner*—Larisa Tsukerman
(74) *Attorney, Agent, or Firm*—Wei Te Chung

(57) ABSTRACT

A cable connector assembly (10) includes an electrical connector (12), a printed circuit board (14), a cable (16) and a plurality of power wires (18). The electrical connector has a housing (24) and a plurality of signal contacts (26) and power contacts (28) mounted in the housing. The cable contains a plurality of center conductors (160) each electrically connecting with a corresponding signal contact. The printed circuit board is received in the housing. The power contacts and the power wires are respectively electrically mounted on the printed circuit board to provide power transmission therebetween. A cover (22) is designed to over-mold the structural connection portion of the electrical connector, the printed circuit board, the cable and the power wires. The cable connector assembly is finally assembled on a panel (20) by a pair of screws (80).

18 Claims, 7 Drawing Sheets

CABLE CONNECTOR ASSEMBLY

CROSS-REFERENCE TO RELATED APPLICATION

This patent application is related to a contemporaneously filed application entitled "CABLE END CONNECTOR ASSEMBLY", invented by the same inventor and assigned to the same assignee as the present application.

BACKGROUND OF THE INVENTION

1. Field of the Invention

The present invention relates to a cable connector assembly, and particularly to a cable connector assembly transmitting power and signals.

2. Description of Related Art

Serial Advanced Technology Attachment (serial ATA) is a recent industry standard serial interface for high speed transmission. The Serial ATA connector standard, generally for disk drives and storage peripherals, includes power and signal members respectively mounted a plurality of electrical spring contacts for providing a power and a signal transmission.

Generally, a conventional electrical cable connector according the serial ATA, the power and signal cable are separately assembled to two electrical connectors for respectively mating with a complementary connector mounted on the mother board. Such a connecting operation is laborious and inconvenient. Furthermore, to form two separate connectors on each of the cable end and on the mother board is expensive, which is disadvantage from the point of view of cost. It is desired to provide a new cable connector assembly connecting the power wire end and signal cable end together for mating with the complementary connector at the same time so that manufacturing and assembling process can be simplified and cost can be reduced.

The cable connector assembly connecting the power wire end and signal cable end together, on the other hand, further need to be provided with a hot-plug functions according with serial ATA. Generally, the contacts thereof are designed to have different dimensions for asynchronously mating/breaking with corresponding contacts of the complementary connector. Understandably, the manufacturing method in this situation, therefore, also adds expense.

Hence, a improved cable connector assembly is required to overcome the disadvantages of the related art.

SUMMARY OF THE INVENTION

Accordingly, a first object of the present invention is to provide a cable connector assembly integrally terminating power and signal members for transmitting power and signals to a complementary connector on a mother board.

In order to achieve the object set forth, a cable connector assembly in accordance with the present invention includes an electrical connector, a printed circuit board, a cable and a plurality of power wires. The electrical connector has a housing and a plurality of signal contacts and power contacts mounted in the housing. The cable contains a plurality of center conductors each electrically connecting with a corresponding signal contact. The printed circuit board is assembled in the housing. The power contacts and the power wires are respectively electrically mounted on the printed circuit board to provide power transmission therebetween. A cover is designed to over-mold the structurally connection portion of the electrical connector, the printed circuit board, the cable and the power wires. The cable connector assembly is finally assembled on a panel by a pair of screws.

Other objects, advantages and novel features of the invention will become more apparent from the following detailed description when taken in conjunction with the accompanying drawings.

DETAILED DESCRIPTION OF THE INVENTION

Figure 1:
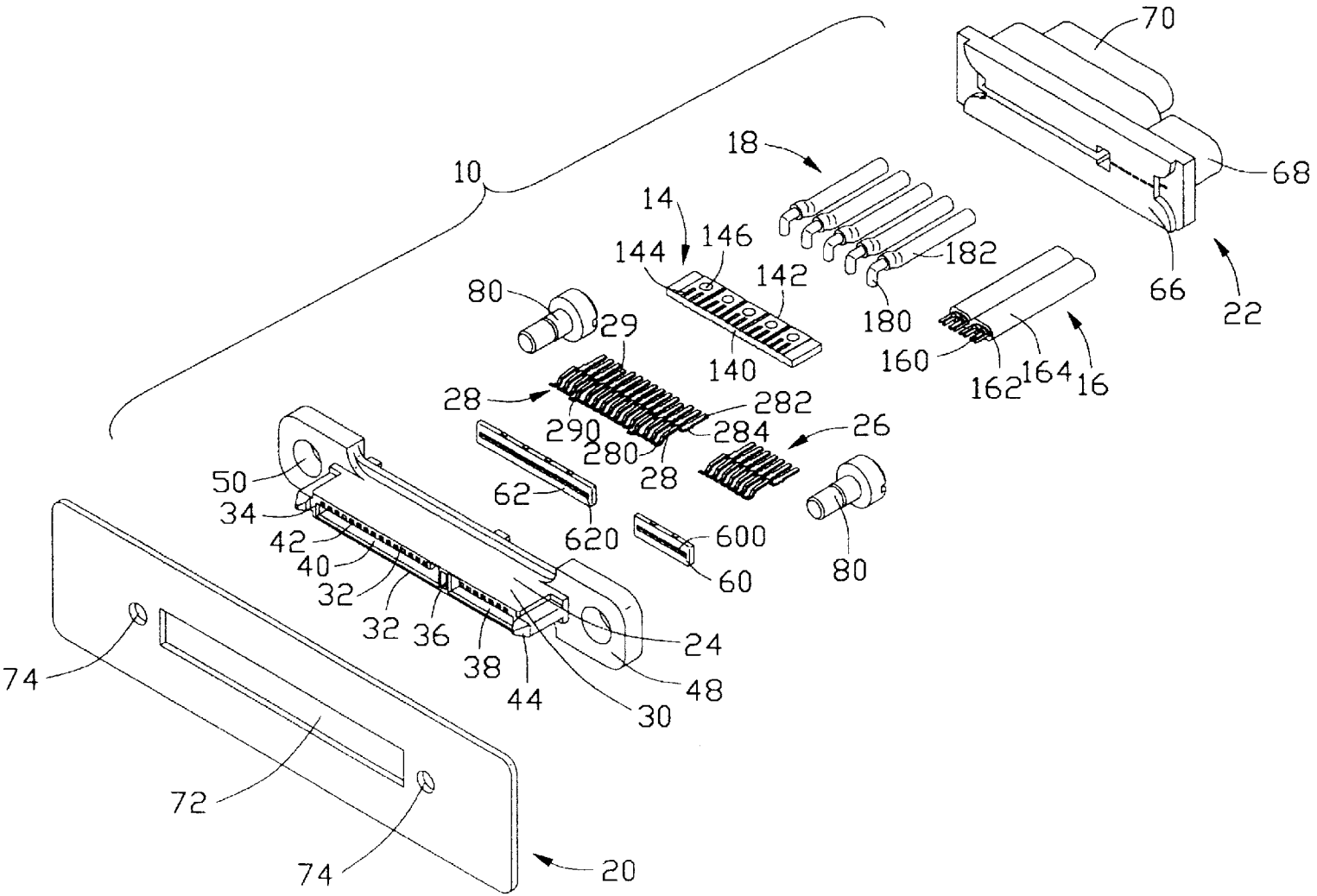
FIG. 1 is an exploded, perspective view of a cable connector assembly in accordance with the present invention.
Figure 3:
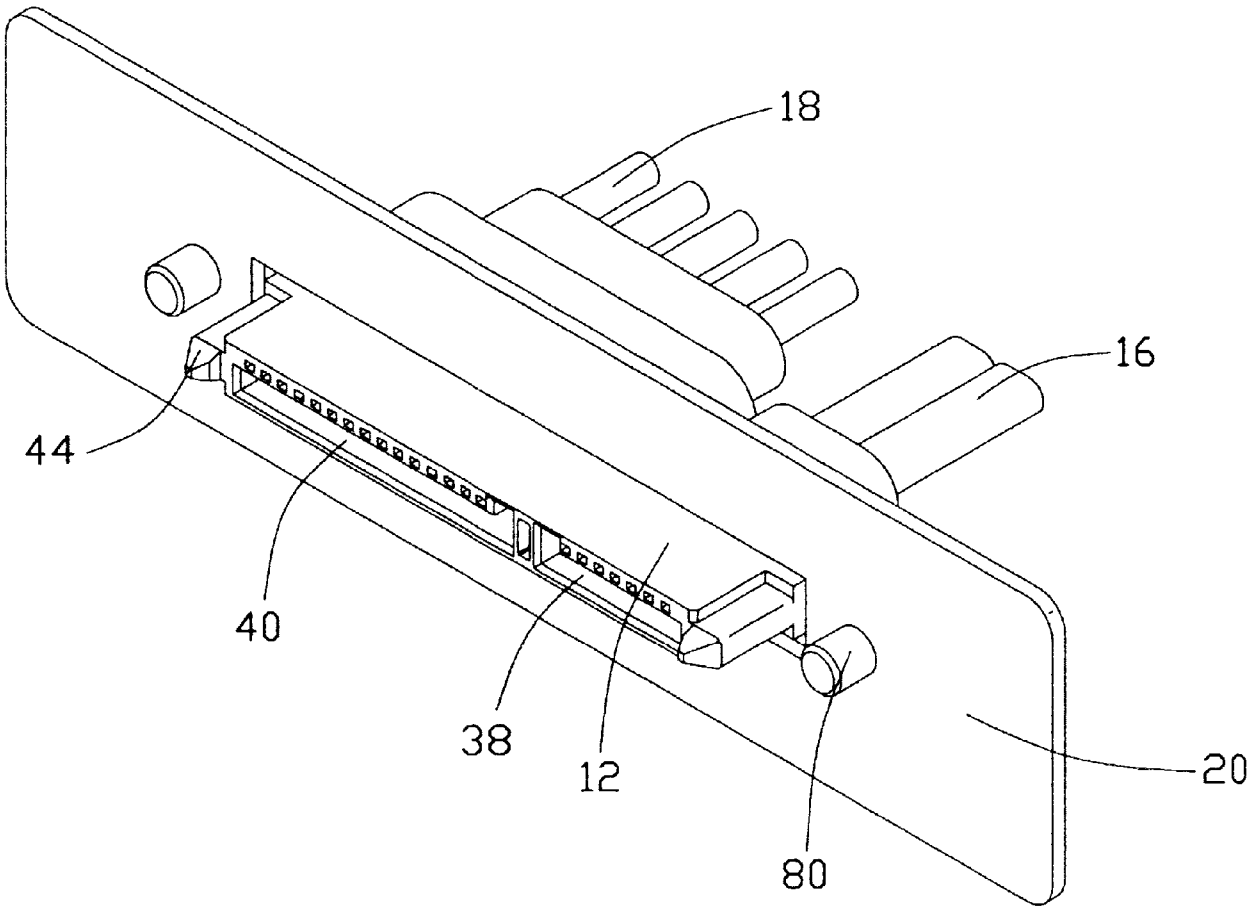
FIG. 3 is an assembled view of the cable connector assembly of FIG. 1.

Referring to FIG. 1 and FIG. 3, a cable connector assembly 10 in accordance with the present invention includes an electrical connector 12, a printed circuit board 14, a signal cable 16, a plurality of power wires 18, a cover 22, a panel 20 and a pair of screws 80. The cable connector assembly 10 is provided to mate with a complementary connector mounted on a motherboard. In the preferred embodiment, the electrical connector 12 is a typical Serial Advanced Technology Attachment (serial ATA) connector, the signal cable 16, correspondingly, is a serial ATA cable. However, in alternative embodiments, features of the present invention could be used with any suitable types of electrical connectors or electrical cables.

Figure 2:
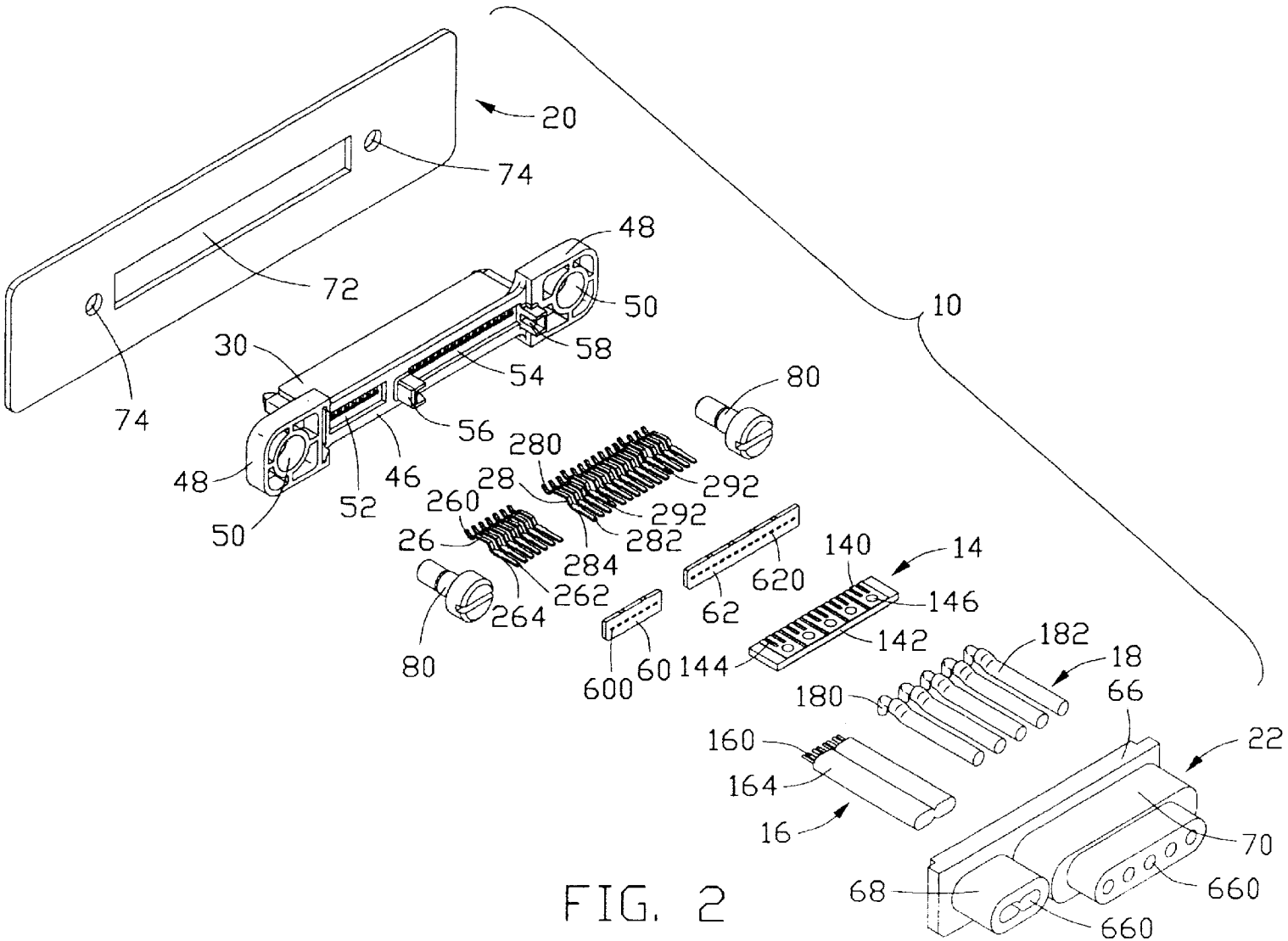
FIG. 2 is a view similar to FIG. 1, but taken from rear aspect.

The electrical connector 12, as best shown in FIGS. 1–2, includes a dielectric housing 24 generally molded of plastic or polymer material, a plurality of signal contacts 26, and a plurality of power contacts 28. Each of the signal contacts 26 and the power contacts 28 has same configuration and dimension. In the preferred embodiment, the housing 24 has an elongate base 30. The elongate base 30 includes a pair of longitudinal sidewalls 32, a pair of lateral ends 34 connecting opposite ends of the longitudinal sidewalls 32, and an intermediate wall 36 extending parallel between the lateral ends 34 and connecting with the longitudinal sidewalls 32. The longitudinal sidewalls 32, the lateral ends 34 and the intermediate wall 36 together define two L-shaped receiving slots 38, 40 therebetween for receiving a mating portion of the complementary connector (not shown). The receiving slot 40 has a longitudinal dimension larger than the other of the receiving slots 38. One of longitudinal sidewalls 32 is thicker than the other of the longitudinal sidewalls 32. A pair of guiding posts 44 is disposed adjacent to the opposite lateral ends 34 of the elongate base 30 for guiding the cable connector assembly 10 to mate with the complementary connector.

The elongate base 30 of the housing 24 further has a rear surface 46, as best shown in FIG. 2. A pair of flanges 48 is formed at the lateral sides of the base 30 adjacent to the rear surface 46. Each flange 48 defines a positioning hole 50 therein. The elongate base 30 defines a first recess 52, and a second recess 54 extending inward from the rear surface 46. The second recess 54 has a longitudinal dimension larger than the first recess 52. The thicker longitudinal sidewall 32 defines a plurality of passageways 42 extending through the elongate base 30 and communicating the recesses 52, 54 with corresponding receiving slots 38, 40. A pair of lateral block portions 56 respectively corresponding to one of the lateral ends 34 and an intermediate wall 36 extends backwardly away the rear surface 46 and each defines a rectangular recess 58. The pair of rectangular recesses 58 faces to each other.

Each of the power and signal contacts 26, 28 stamped and formed from a conductive metal sheet into the shape, includes a contact portion 260, 280 at one end thereof adapted to be received in a corresponding passageway 42 of the housing 24, a tail portion 262, 282 at the other end thereof, and a retention portion 264, 284 connecting the contact portion 260, 280 and the tail portion 262, 282. Each tail portion 262 of the signal contact 26 is proposed to connect with a corresponding center conductor 160 of the cable 16 and each tail portion 282 of the power contact 28 is adapted for surface connection, such as by soldering, to a corresponding circuit pad 144 of the printed circuit board 14 which will be described hereinafter.

The electrical connector 12 further comprises a first spacer 60 and a second spacer 62 which respectively has a certain configuration and dimension for being nicely inserted into the first recess 52 and the second recess 54. The first spacer 60 and the second spacer 62 respectively define a plurality of rectangular holes 600, 620 therein.

The printed circuit board 14, which is generally rectangular, has a front side 140 and a rear side 142. A plurality of circuit pads 144 is attached on an upper surface of the printed circuit board 14 adjacent to the front side 140 thereof. A plurality of through holes 146 is defined in the printed circuit board 14 adjacent to the rear side 142.

Figure 6:
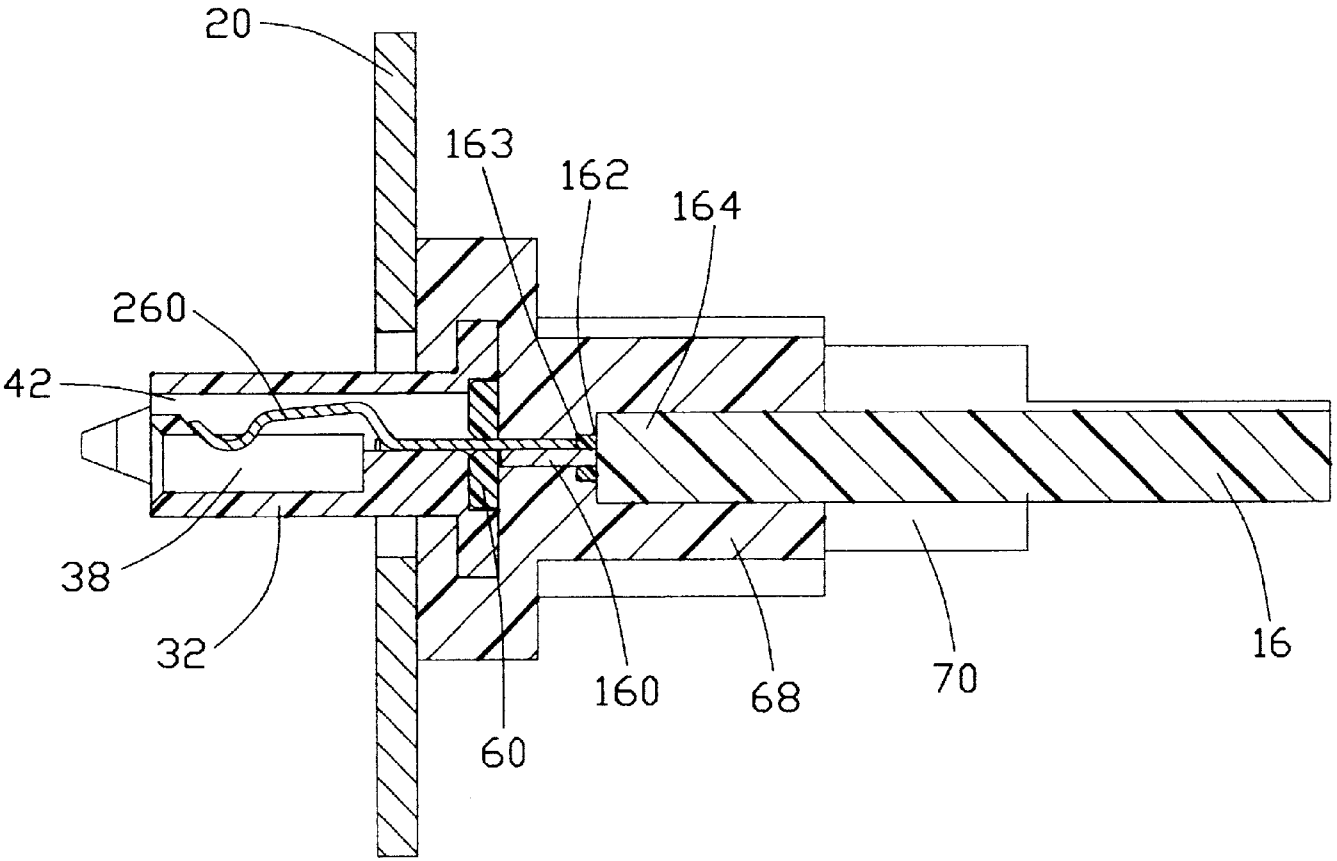
FIG. 6 is a cross-sectional view taken along section line 6—6 of FIG. 5.

The signal cable 16 contains a plurality of center conductors 160 and a plurality of outer conductors 162 made of woven strands of a conductive metal that are separated by an insulating layer 163 (FIG. 6). The outer conductors 162 are covered with a coating layer 164. The tip part of the cable 16 is stripped of the coating layer 164 so that the center conductors 160 are exposed for being connected with corresponding signal contacts 26 of the electrical connector 12 as described hereinafter.

Each power wire 18 comprises a center conductor 180 and an insulative layer 182 enclosing the center conductor 180. Similarly to the signal cable 16, the tip part of each wire 18 is stripped of the insulative layer 182 so that the center conductor 180 is exposed. The tip part of each center conductor 180 bends downwardly for being inserted into corresponding through holes 146 defined in the printed circuit board 14.

Next, a description will be given structurally of connection between the signal cable 16, the power wires 18, the printed circuit board 14, and the electrical connector 12.

Figure 4:
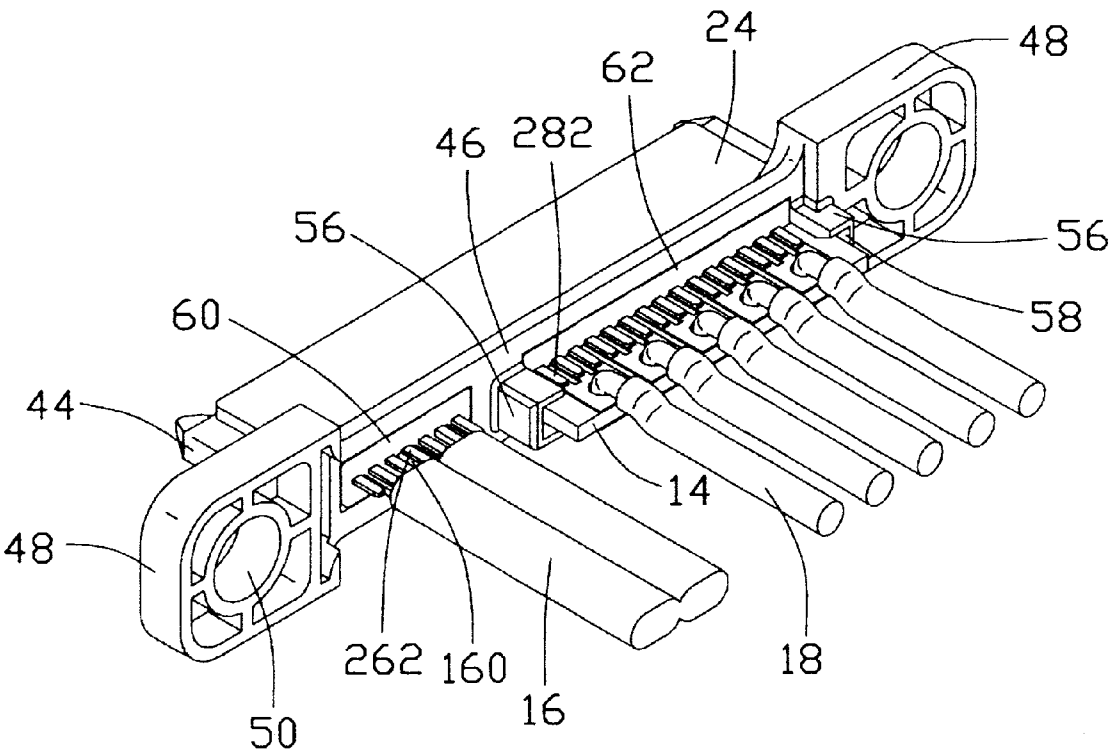
FIG. 4 is a perspective assembled view of the cable connector assembly of FIG. 1 with a cover and a panel removed.
Figure 7:
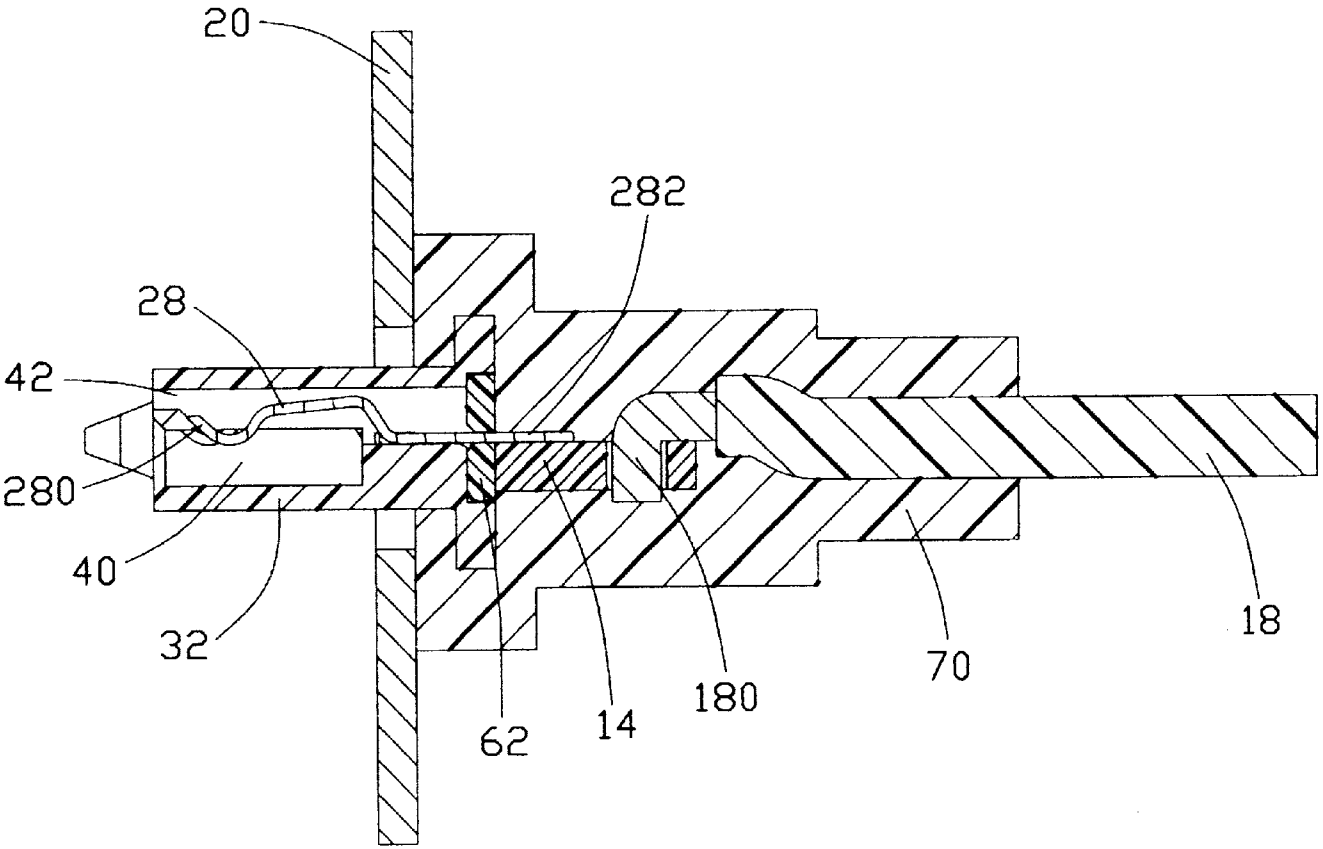
FIG. 7 is a cross-sectional view taken along section line 7—7 of FIG. 5.

Referring to FIGS. 1, 2 and 4 in conjunction to FIGS. 6 and 7, the signal contacts 26 and the power contacts 28 are respectively assembled in the housing 24 from the rear surface 46 thereof with each contact portion 260, 280 being inserted into the passageways 42 and partially projecting into corresponding receiving slots 38, 40. Each retention portion 264, 284 of the contacts 26, 28 engages with the housing 24 and provides a secure and stable retention between the signal and power contacts 26, 28 and the housing 24. The tail portions 262 of the signal contacts 26 and the tail potions 282 of the power contacts 28 respectively abut against the bottom surfaces of the first recess 52 and the second recess 54. Further, the first spacer 60 and the second spacer 62 are respectively inserted into the first recess 52 and the second recess 54. Correspondingly, each of the tail portions 262, 282 of the contacts 26, 28 respectively extends through a corresponding rectangular hole 600, 620 of the first and second spacers 60, 62.

Figure 5:
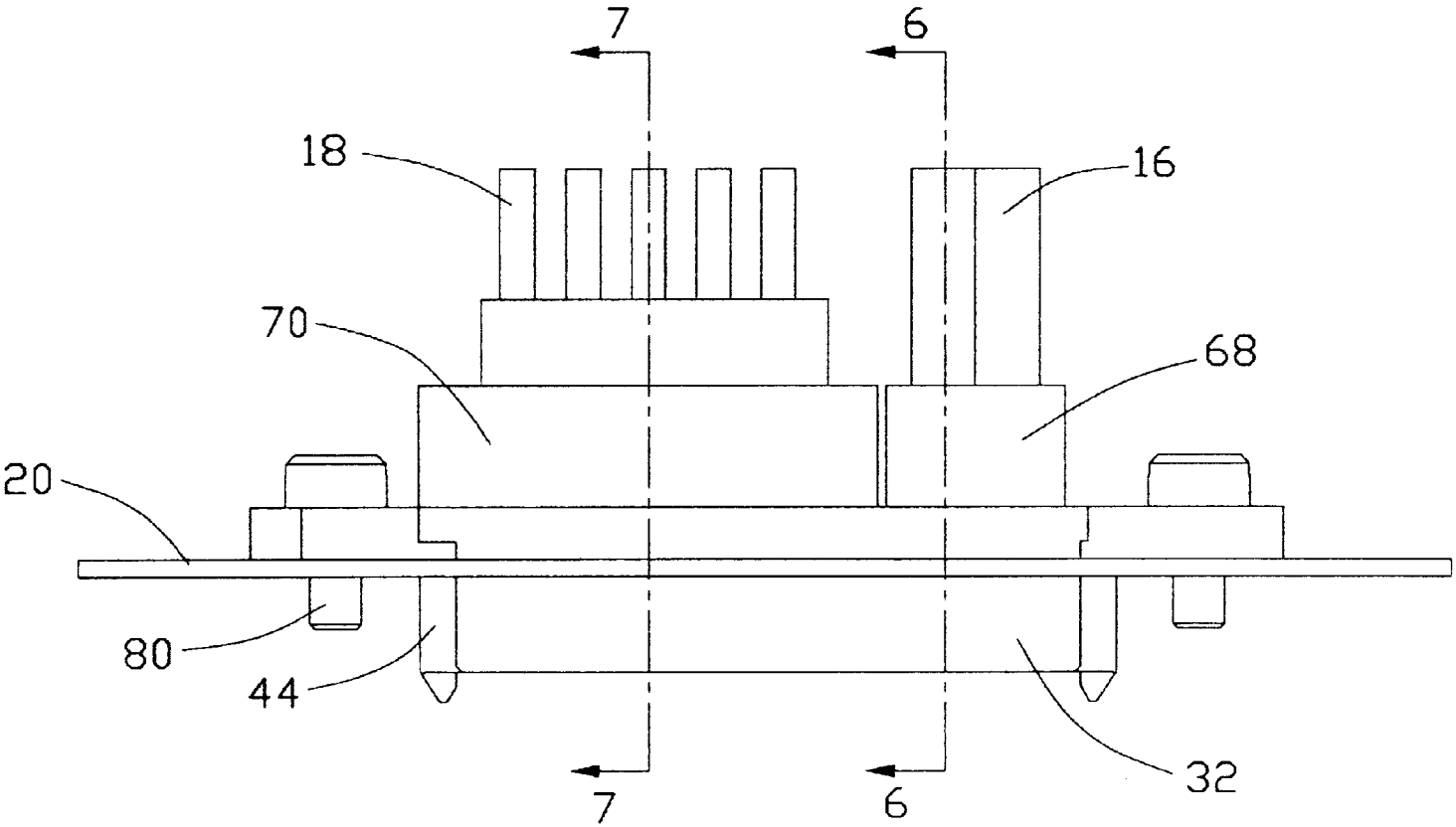
FIG. 5 is a top plan, assembled view of the cable connector assembly of FIG. 1.

Next, with the tail portions 262 of the signal contacts 26 being respectively connected to corresponding center conductors 160 of the cable 16 by soldering therebetween, the signal contacts 26 of the electrical connector 12 and the cable 16 are integrated and the signal transmission lines are provided, as best shown in FIG. 4 and FIG. 5. Further, the front side 140 of the printed circuit board 14 abuts the rear surface 46 of the housing 24 of the electrical connector 12 with the both lateral sides thereof (not shown) being received into corresponding rectangular recesses 58 of the lateral end portions 56. Each tail portion 282 of the power contacts 28 is soldered on a corresponding circuit pad 144 of the printed circuit board 14. The power wires 18 are arranged on an upper surface of the printed circuit board 14 with the center conductors 180 thereof being inserted in corresponding through holes 146 of the printed circuit board 14 and then soldering thereto, as shown in FIG. 4 and FIG. 6. Therefore, power transmission between the power wires 18 and the electrical connector 12 is established via the printed circuit board 14.

It should be appreciated that one feature of the present invention is that the cable connector assembly 10 includes the printed circuit board 14 to interconnect the electrical connector 12 and the power wires 18. Two tail portions 292 of a pair of power contacts 29 are soldered on corresponding circuit pads 144 like other tail portions 282 of the power contacts 28 but more adjacent to the front side 140 thereof. The contact portions 290 of the pair of power contacts 29 firstly mate with corresponding contacts of the complementary connector and last break therebetween. In other words, the cable connector assembly 10 in according with the present invention has a plurality of contacts 26, 28 having same configuration and dimension that can provide hot-pluggable functions. Compared to that the contacts of the connector assembly of prior art with different dimension, the cable assembly 10 can be produced efficiently and easily.

Next, the cover 22, which is generally made of polyvinyl chloride (PVC), is then provided to over-mold to the rear end of housing 22, the printed circuit board 14, the tip part of the cable 16 and the tip part of the power wires 18. The cover 22 includes a rectangular body 66 and a pair of holder portions 68, 70 respectively extending rearwardly from the body 66. The body 66 defines a plurality of channels 660 through the cover for respectively receiving the tip parts of the cable 16 and the power wires 18 which is known to persons skilled in the art and the detailed description thereof is omitted here.

It should be noted that the electrical connector 12 has the first spacer 60 and the second spacer 62 respectively nicely inserted into the first recess 52 and the second recess 54. The spacers 60, 62 can prevent molten PVC from flowing into the passageways 42 via the recesses 52, 54 when the cover 22 is over-molded to the housing 22, the cable 16 and the power wires 18. The signal and power transmission characteristic of the cable connector assembly 10 would be not affected.

Finally, the electrical connector 12, the printed circuit board 14, the cable 16, the power wires 18 and the cover 22 are assembled to form a subassembly. The subassembly is mounted on the panel 20 with the front portion (not labeled) of the housing 24 extending through a transverse slot 72 defined in the panel 20. Furthermore, the panel 20 defines a pair of holes 74 corresponding to the positioning holes 50 of the flanges 48. A pair of screws 80 is designed to extend through the corresponding positioning holes 50 of the electrical connector 12 and the holes 74 of the panel 20 and used for threadedly fastening the cable connector assembly 10 with the complementary connector, when mated together.

As mentioned above, the advantages of the prevent invention is that a cable connector assembly 10 is provided which is integrated connected with the signal cable 16 and the power wires 18. The manufacturing and assembling process of the cable connector assembly 10 is thus simplified. Furthermore, the cable connector assembly 10 has the printed circuit board 14 which interconnects the electrical connector 12 and the power wires 18. The contacts 26, 28 of the electrical connector 12 have same configuration and dimension for supplying hot-pluggable functions simultaneously, understandably, the electrical connector 12 can be produced efficiently and easily.

Further, the cable connector assembly 10 includes the cover 22 which is over-molded to the subassembly of the electrical connector 12, the printed circuit board 14, the cable 16 and the power wires 18 to protect the structural connection therebetween. The cable connector assembly 10 is finally fastened to the panel 20. The panel 20 can provide a reliable structural connection with the complementary connector by the pair of screws 80.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

an electrical connector having a housing and a plurality of signal contacts and power contacts mounted in the housing, the housing comprising an elongated base having a rear surface, the base defining a pair of recesses extending inwardly from the rear surface thereof;

a cable having a plurality of center conductors each electrically connecting with a corresponding signal contact;

a printed circuit board received in the housing;

a plurality of power wires each having a center conductor; and a pair of spacers respectively received in the recesses of the housing:

the power contacts of the electrical connector and the center conductors of the power wires respectively electrically mounted on the printed circuit board to provide power transmission therebetween.

2. The cable connector assembly as claimed in claim 1, wherein the printed circuit board comprises a plurality of circuit pads adjacent a front side thereof, and each power contact of the electrical connector has a tail portion soldered on a corresponding circuit pad thereof.

3. The cable connector assembly as claimed in claim 2, wherein one of the plurality of power contacts is soldered on a corresponding circuit pad closer to the front side of the printed circuit board than other power contacts.

4. The cable connector assembly as claimed in claim 1, wherein the printed circuit board defines a plurality of through holes adjacent to a rear side thereof, each center conductor of the power wire is inserted into a corresponding through hole and soldered thereto.

5. The cable connector assembly as claimed in claim 1, wherein the housing defines a pair of lateral block portions extending backwardly from the rear surface thereof, each lateral block portion defining a rectangular recess receiving and engaging with the lateral sides of the printed circuit board.

6. The cable connector assembly as claimed in claim 1, further comprising a panel defining a transverse slot allowing the elongate base of the housing of the electrical connector extending therethrough.

7. The cable connector assembly as claimed in claim 6, wherein the panel defines a pair of holes at a pair of sides of the transverse slot, and the housing has a pair of flanges formed at a pair of lateral sides thereof and each flange defining a positioning hole corresponding to a corresponding hole of the panel.

8. The cable connector assembly as claimed in claim 7, further comprising a pair of screws extending through the positioning holes of the flanges of the housing and the holes of the panel.

9. The cable connector assembly as claimed in claim 1, wherein each of the signal contacts and the power contacts has same configuration and dimension.

10. The cable connector assembly as claimed in claim 1, wherein the housing defines a pair of guiding posts adjacent to opposite lateral ends of the elongate base.

11. The cable connector assembly as claimed in claim 1, wherein the electrical connector is a Serial Advanced Technology Attachment (serial ATA) connector.

12. A cable connector assembly comprising;

an electrical connector having a housing and a plurality of first contacts and second contacts mounted in the housing;

a cable having a plurality of first and second center conductors, each first center conductor electrically connecting with a corresponding first contact;

a printed circuit board mounted in the housing, the second contacts and the second center conductors electrically soldered on the printed circuit board to form electrical connection therebetween and each of the second center conductors of the cable corresponding to more than one of the second contacts; and a cover over-molded with and enclosing a rear end of the housing and the cable.

13. The cable connector assembly as claimed in claim 12, wherein the housing has a pair of flanges formed at a pair of lateral sides thereof, each flange defining a positioning hole therein.

14. The cable connector assembly as claimed in claim 13, further comprising a panel defining a transverse slot receiving a front portion of the housing and a pair of holes at a pair of sides of the transverse slot each corresponding to a positioning hole of the flange.

15. The cable connector assembly as claimed in claim 14, further comprising a pair of screws extending through the positioning holes of the flanges and the holes of the panel.

16. The cable connector assembly as claimed in claim 12, wherein the first contacts are signal contacts, and the second contacts are power contacts.

17. A cable connector assembly comprising:

an electrical connector unit including an insulative housing with therein a plurality of contacts extending along a front-to-rear direction, each of the contacts including a straight tail extending rearwardly beyond a rear face of the housing;

a cavity formed in said rear face;

a vertical spacer received in said space and veiling said rear face of the housing except with defining a plurality of slits through which said tails snugly extend rearwardly;

a pair of block portions extending rearwardly from the rear face to form a pair of opposite channels thereof;

a horizontal printed circuit board located behind the spacer and between said pair of channels, and said tails soldered on a front portion of the printed circuit board; and a plurality of wires connected to a rear portion of the printed circuit board.

18. The cable connector assembly as claimed in claim 17, wherein each one of said wires corresponding to more than one of the contacts.

* * * * *